US006966072B1

(12) United States Patent
Kobayashi

(10) Patent No.: US 6,966,072 B1
(45) Date of Patent: Nov. 22, 2005

(54) HAT WITH SHADING COVER AND HOOD WITH SHADING COVER

(76) Inventor: Toyohiro Kobayashi, 2-2-11 Sumiredai, Yaizu-shi Shizuoka (JP) 425-0053

( * ) Notice: Subject to any disclaimer, the term of this patent is extended or adjusted under 35 U.S.C. 154(b) by 0 days.

(21) Appl. No.: 10/069,932

(22) PCT Filed: Sep. 14, 2000

(86) PCT No.: PCT/JP00/06310

§ 371 (c)(1),
(2), (4) Date: Mar. 5, 2002

(87) PCT Pub. No.: WO01/35778

PCT Pub. Date: May 25, 2001

(30) Foreign Application Priority Data

Nov. 15, 1999 (JP) ..... 11/361465

(51) Int. Cl.[7] ..... A42B 1/24
(52) U.S. Cl. ..... 2/209.13
(58) Field of Search ..... 2/209.13, 175.6, 2/202, 205, 206, 195.1, 200.1; 607/109, 110

(56) References Cited

U.S. PATENT DOCUMENTS 4,180,868 A * 1/1980 Snow ..... 2/203
5,046,195 A * 9/1991 Koritan ..... 2/172
5,161,260 A * 11/1992 Reynolds ..... 2/207
5,557,807 A * 9/1996 Hujar et al. ..... 2/171.2
5,603,120 A * 2/1997 Gifford ..... 2/172
5,605,144 A * 2/1997 Simmons et al. ..... 126/204
5,623,732 A * 4/1997 Olajide, Jr. ..... 2/195.1
5,669,074 A * 9/1997 Newman, Jr. ..... 2/172
5,950,241 A * 9/1999 Gomez ..... 2/172
5,956,759 A * 9/1999 Benedict ..... 2/7
6,381,750 B1 * 5/2002 Mangan ..... 2/10

FOREIGN PATENT DOCUMENTS

| | | |
|---|---|---|
| JP | 3-269107 | 11/1971 |
| JP | 4-39379 | 2/1992 |
| JP | 7-33942 | 6/1995 |
| JP | 9-170108 | 6/1997 |
| JP | 10-339536 | 12/1998 |

* cited by examiner

*Primary Examiner*—Katherine M Moran

(57) ABSTRACT

A cap has a cap body; a sunshade cover removably and rotatably connected to the cap body by means for connecting, having a cooling material; the connecting means having a projection received in a recess, arrangement of the projection in the recess allowing for rotation of the sunshade cover between the extended and stored positions; and a fixing means for detachably fixing the sunshade cover in either the extended position or the stored position so that it can protect the back part of the head and nape of a person under a scorching sun from the direct rays and the heat of the sun and having a cold insulator incorporated therein to keep cool the head and nape of the wearer for a long time.

7 Claims, 5 Drawing Sheets

HAT WITH SHADING COVER AND HOOD WITH SHADING COVER

BACKGROUND OF THE INVENTION

This invention relates to a cap, including a hat, hood and the like, with a sunshade cover.

When people are outdoors under strong sunlight for a long time, they not only wear a cap on the head may put a wet towel between the head and the cap in order to avoid having sunstroke and/or being badly sunburned on the back of the neck. However the wet towel dries quickly under the strong sunlight and also may be displaced when a strong wind blows. Japanese Utility Model Application No. 61-156545 discloses a "Head Cooling Cap" in which is installed a rosin material that absorbs water very well therein and cools the head of the cap wearer by absorbing the heat in the space surrounding the cap. This cap, however, cannot cool and protect from strong sunlight the back of the head and neck. Since it also has to be entirely dipped into water before it is worn, such a cap is uncomfortable.

SUMMARY OF THE INVENTION

Accordingly, it is an object of the invention to provide a cap with a shading cover which can protect the back part of the head and nape of a person under a scorching sun from the direct rays and the heat of the sun and having a cold insulator incorporated therein to keep cool the head and nape of the wearer for a long time.

DETAILED DESCRIPTION OF THE INVENTION

Figure 1:
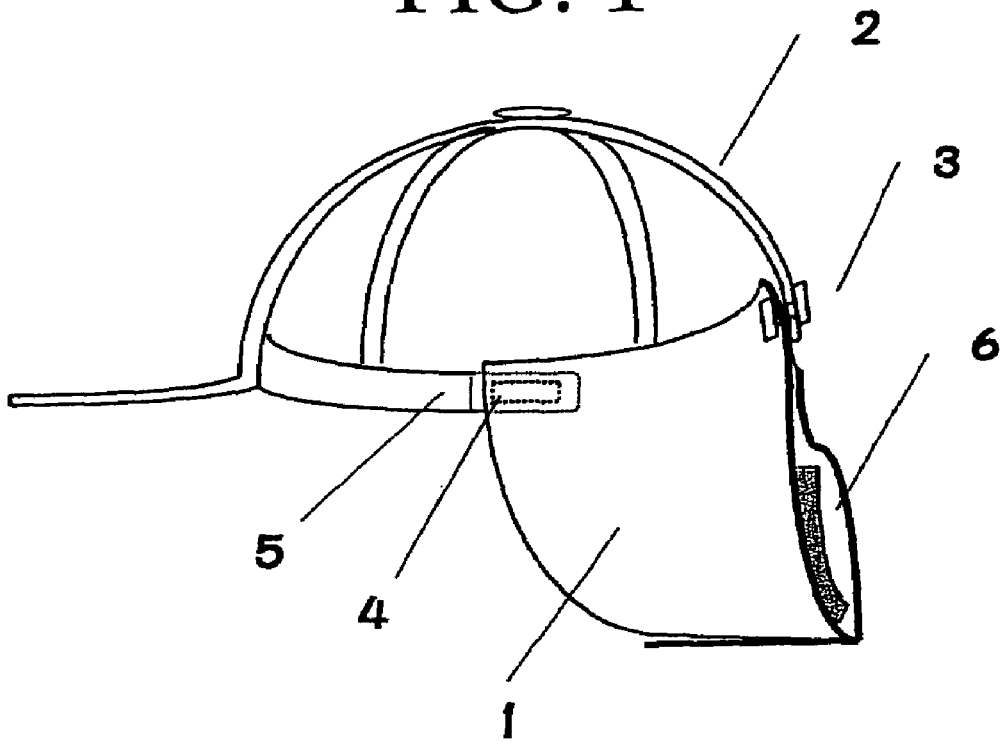
FIG. 1 is a cross section side view of a cap with a sunshade cover in an extended position showing a first embodiment of the present invention.
Figure 2:
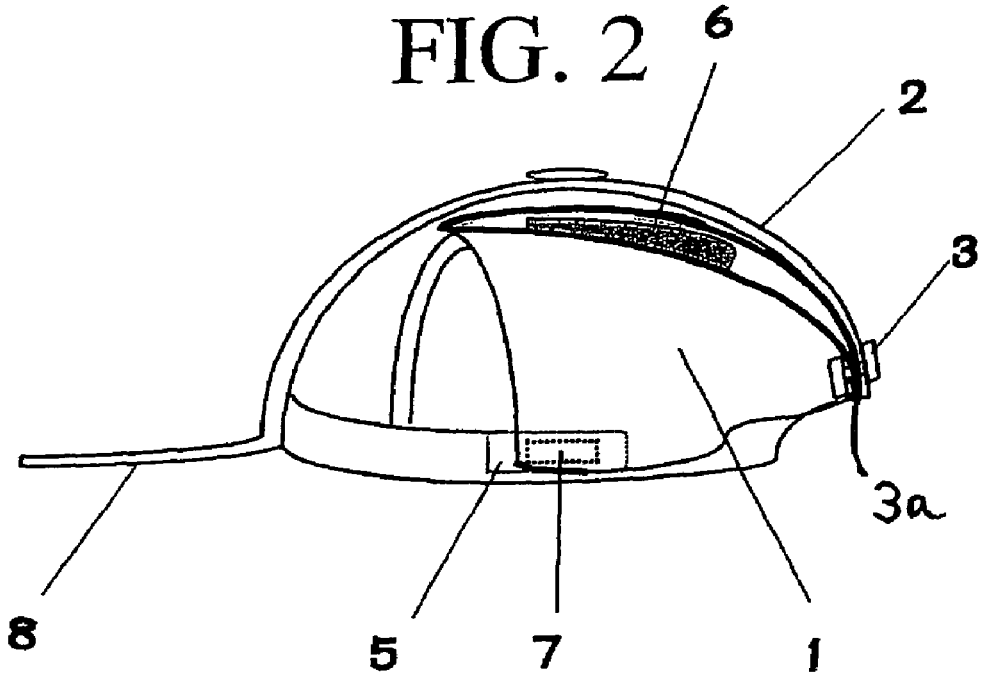
FIG. 2 is a cross sectional view of the cup of FIG. 1 with the sunshade cover in a stored position.

Referring now to the drawings, FIGS. 1 and 2 are cross-sectional views of a cap according to a preferred embodiment. The cap comprises a cap body 2 and a sunshade cover 1. The cap body 2 has a visor 8. As shown in FIG. 1, the sunshade cover 1 is hanging down from the cap body 2. In contrast, the cover 1 is kept inside the cap body 2 in FIG. 2.

Figure 3:
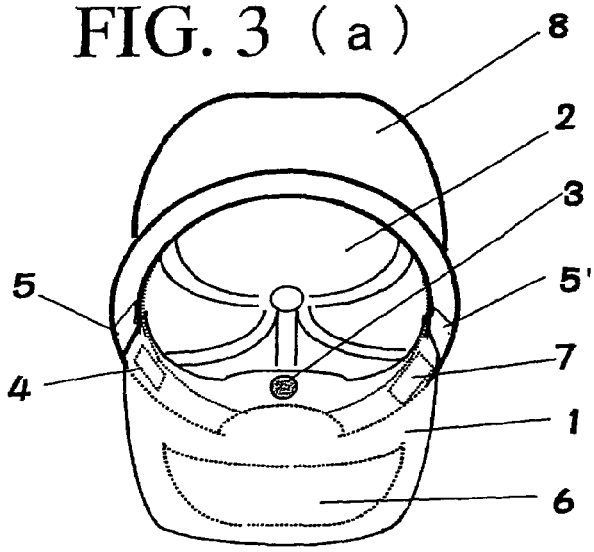
FIG. 3 illustrates how to use the cap of the present invention.
Figure 3:
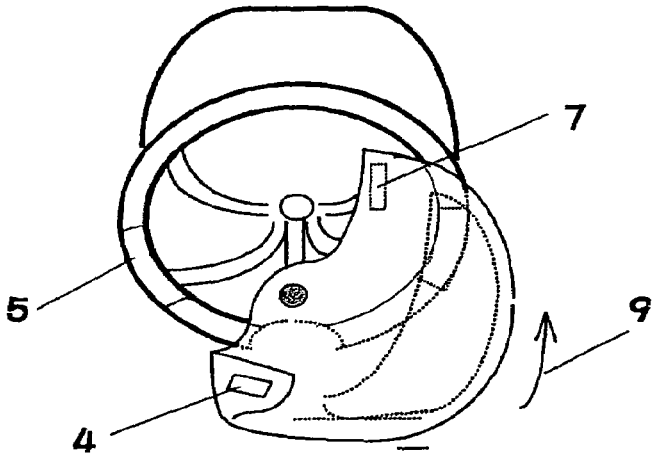
Figure 3:
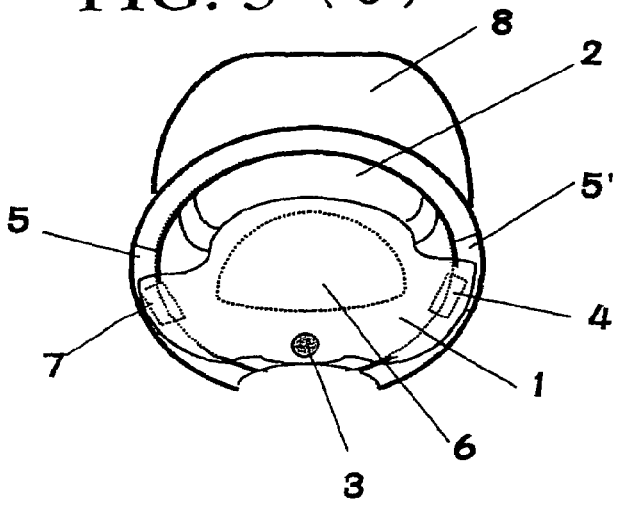
Figure 5:
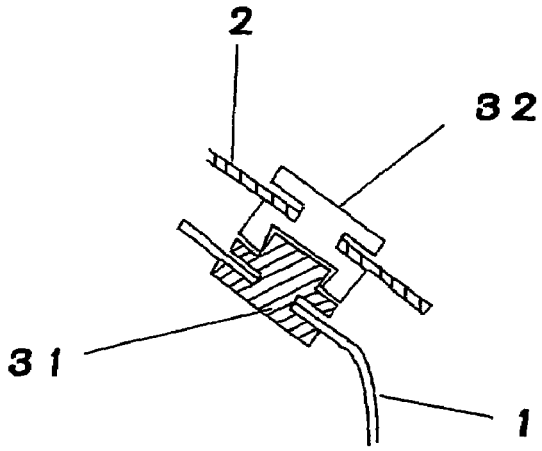
FIG. 5 is an explanation view of a connector that connects removably and rotatably the sunshade cover to the cap body.

As may be better seen from FIG. 3(*a*), the cap body 2 is provided with two opposed burred sides 5 and 5' of a double-sided adhesive at the inside of its circumferential edge. Similarly, the sunshade cover 1 is provided with two opposed looped sides 4 and 7 of a double-sided adhesive at its outside. As shown in FIG. 3(*a*), the looped side 4 of the double-sided adhesive of the sunshade cover 1 can be joined with the burred side 5 of the double-sided adhesive of the cap body 2, and the looped side 7 of the double-sided adhesive of the cover 1 can be joined with the burred side 5' of the double-sided adhesive of the cap body 2. The two opposed sides of the sunshade cover 1 can be thus fastened to the cap body 2. In addition, as shown in FIGS. 1, 2 and 3(*a*) to 3(*c*), the sunshade cover 1 can be also connected to the inside of the cap body 2 by means of a middle connector 3 at its middle portion. This middle connector 3 is passing through openings (not shown) made in the cover 1 and the cap body 2 (FIG. 5).

The sunshade cover 1 has an inner space that contains a relatively small bag of fabric, or cooling member 6 (FIGS. 1 and 2), containing a material that absorbs water very well and stitched into the inner space in such a manner that the small bag is accommodated flat in the inner space. And, as such a water-absorbing material to be put into the small bag, one can effectively use, for example, fibers obtained by processing a polymer that contains the sodium salt of polyacrylic acid as a major component.

This cap of the preferred embodiment of the invention can be very effectively used to avoid sunstroke when one is exposed to direct or strong sunlight for a long time. In use, one first dips the sunshade cover 1, and only the sunshade cover 1, into water, so that the cooling member 6 thus absorbs the water very well. Then, he or she puts the cap on his or her head with its sunshade cover 1 hanging down from the cap body 2 as shown in FIGS. 1 and 3(*a*). The wearer of the cap is now ready to carry out some activity or sit or stand still for a long time under strong sunlight, because the cooling member 6 absorbs the heat of the space surrounding this member 6 as the water absorbed by the above-mentioned water-absorbing material evaporates under strong sunlight. The sunshade cover 1 thus cools the head of the cap wearer under strong sunlight. To be exact, the sunshade cover 1 cools both the lower part of the back of the head and the back of the neck when that cover 1 is hung down from the cap body 2.

In addition, one can also wear this cap of the preferred embodiment of the invention in order to cool the top of his head under strong sunlight, because the sunshade cover 1 can be shifted from an extended position of FIGS. 1 and 3(*a*) to a stored position of FIGS. 2 and 3(*c*) in the cap body 2. To shift the cover 1 to this stored position, one first pulls apart the looped fastener element 4 and the burred fastener element 5 and also pulls apart the looped fastener element 7 and the burred fastener element 5'. Then, one turns the sunshade cover 1 in either one of two opposite directions, as shown in FIG. 3(*b*). In FIG. 3(*b*), the cover 1 is being turned in a counterclockwise direction 9 when viewed from under the cap. And this turning is done for an angle of 180 degrees, and then this time the looped fastener element 7 is joined with the burred fastener element 5 and the looped fastener element 4 is joined with the burred fastener element 5', as illustrated in FIG. 3(*c*). The sunshade cover 1 thus can be shifted to the stored position in the cap body 2. In this position the sunshade cover 1 can cool both the upper part of the back of the head and the top of the head, as can be seen from FIG. 2.

The reason why the cover 1 can be turned in such a manner is because of the construction of the middle connector 3 with a stopper pin 3*a* Detailed construction of this connector 3 is shown in FIG. 5.

As illustrated in FIG. 5, this connector 3 comprises a male piece 31 passing through the thickness of the sunshade cover 1 and a female piece 32 passing through the thickness of the cap body 2. The male piece 31 has a projecting portion 31A in the shape of an inverted trapezoid, and the female piece 32 has a complementary recess 32A into which the projecting portion 31A is rotatably fit. Thus the male piece 31 and female piece 32 are mated with each other such that the male piece 31 can be rotated. Thus the sunshade cover 1 can be turned or shifted to the stored position of FIG. 2 by rotating the male piece 31.

In addition, the male piece 31 can be separated from the female piece 32 to detach the sunshade cover 1 from the cap body 2. If it is detached from the cap body 2, one can wear this cap as a usual cap.

It will be appreciated that this cap of the preferred embodiment of the invention is very suitable for, for example, a spectator at a baseball or soccer game played under a burning sun in the height of summer. The wearer of this cap can feel pleasantly cool at the head under such a condition. If a design or pattern is printed on the sunshade cover 1, it is usually printed on the outside of the cover 1. This cover 1 contacts the head of the cap wearer at its inside either when the cap is worn with the cover 1 in the extended position of FIG. 1 or when it is worn with the cover 1 in the stored position of FIG. 2. Therefore, the outside of the cover 1, or the printed side thereof, is not polluted by the cap wearer's hair.

Figure 4:
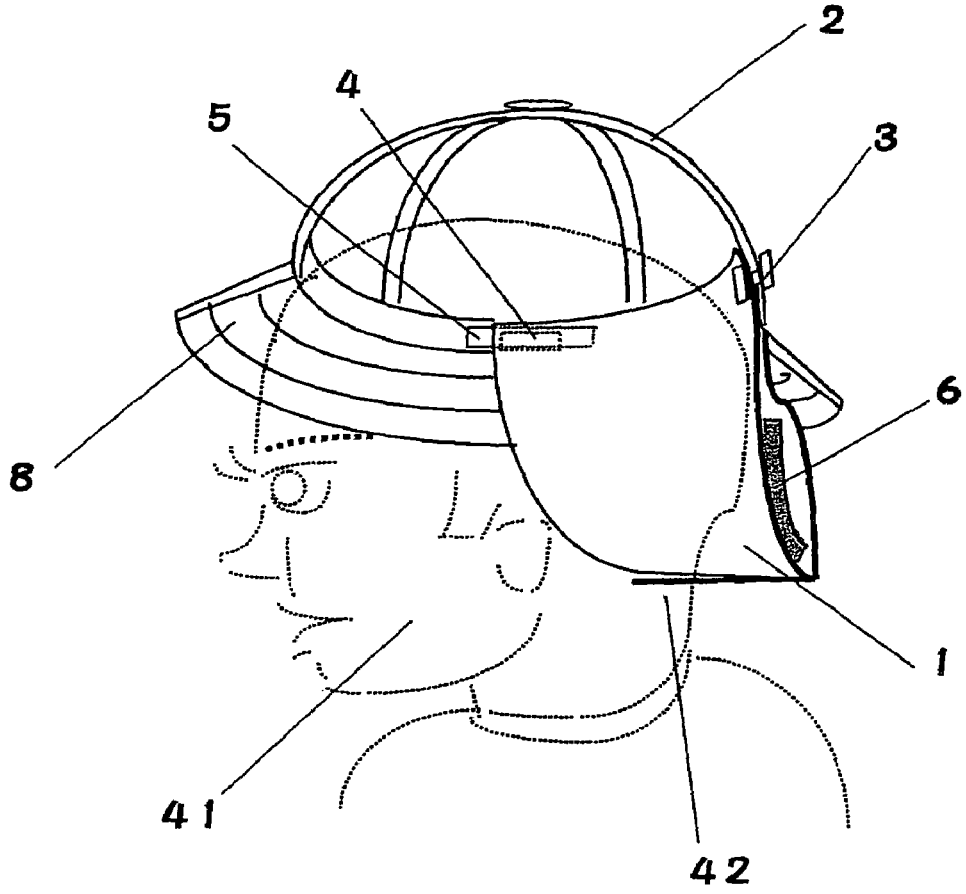
FIG. 4 is a cross sectional view of a cap formed in the shape of a hat with a sunshade cover showing an alternative embodiment of the present invention.

FIG. 4 depicts a hat with a sunshade cover 1. In FIG. 4 the same reference numerals as those of the cap are used to designate parts similar to those of the cap. As with the cap, the sunshade cover 1 of the hat of FIG. 4 contains an inner cooling member 6. The sunshade cover 1 is removably connected to a cap body 2 in a similar manner to the sunshade cover 1 of the cap.

Figure 6:
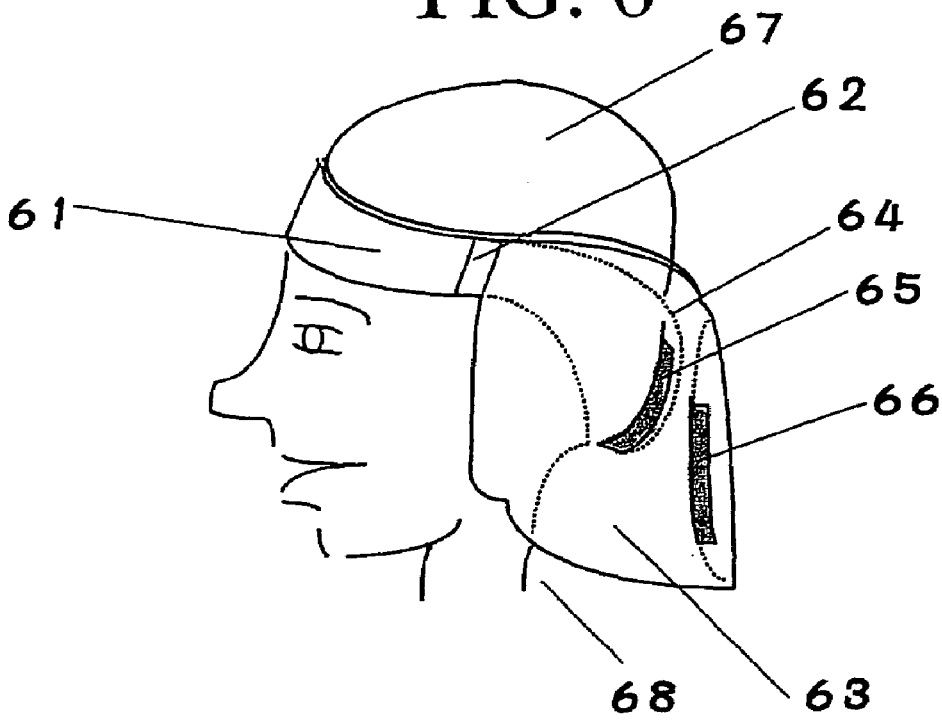
FIG. 6 is a cross-sectional side view of a hood with a sunshade cover showing a second embodiment of the present invention.
Figure 7:
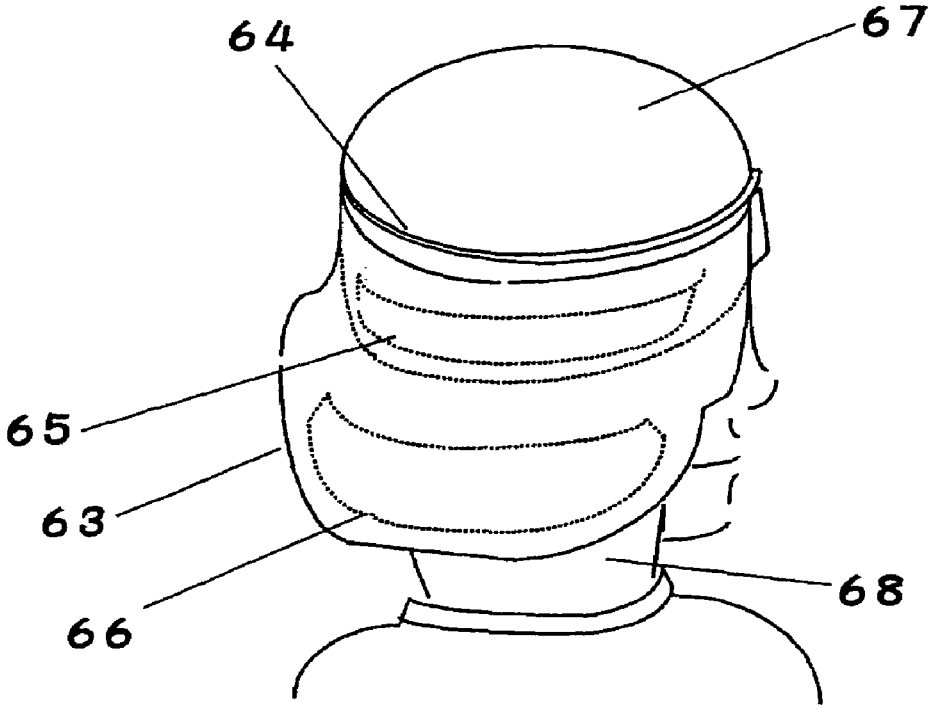
FIG. 7 is a rear view of FIG. 8.
Figure 8:
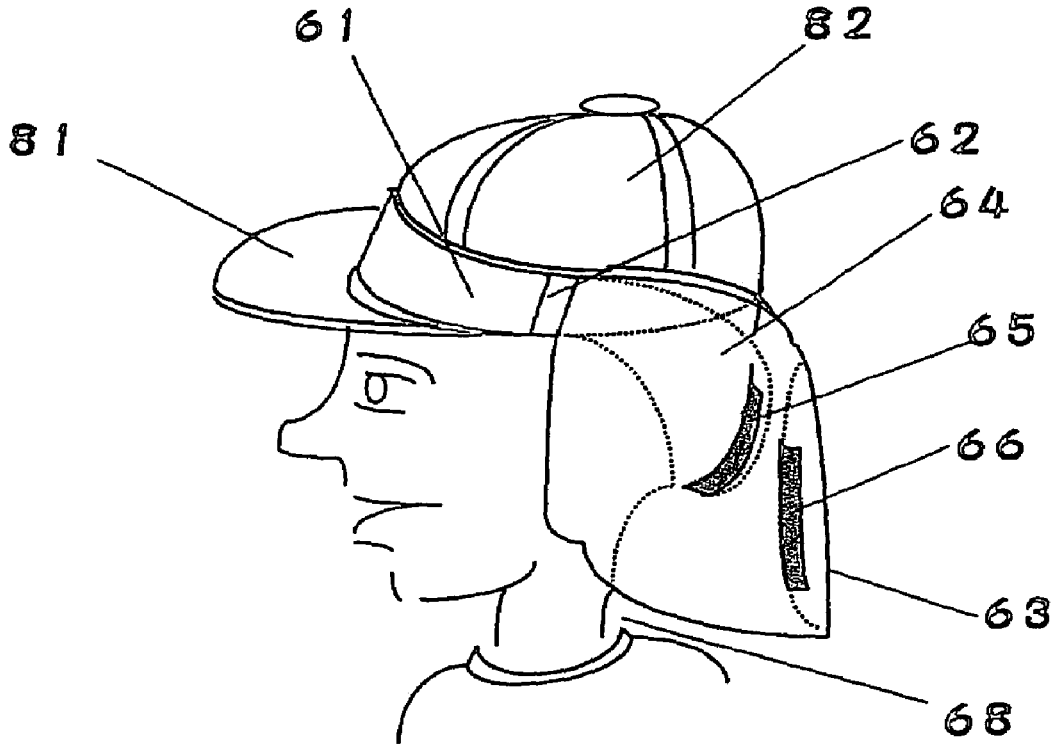
FIG. 8 is a cross-sectional side view of the hood worn over a cap.

FIGS. 6, 7 and 8 illustrate a second embodiment of the invention. That is, these Figures show a hood with a sunshade cover. Reference numerals 61 and 64 designate the front and back, respectively, of a headband part of elastic material. The front 61 of the headband part is secured to a sunshade cover 63 at 62, as by stitching. A cooling member 65 is provided in the back 64 of the headband park and is in such a position as to cool the back of the head 67 of a hood wearer. Also, another cooling member 66 is provided in the sunshade cover 63, and is in such a position as to cool chiefly the back 68 of the neck. The same water-absorbing material as in the cap of FIG. 1 may be put into the cooling members 65 and 66. If desired, as shown in FIG. 8, one can wear the hood of FIGS. 6 and 7 over a usual cap. If one wears the hood in such a manner, not only does the sunshade cover 63 cool the head and the back of the neck of the wearer, but the head serves to secure the cap to the head and hence prevents the cap from being blown off by a strong wind.

As set forth above, by wearing the cap of the preferred embodiment of the invention, it prevents direct rays from the sun reaching the back of the head or a neck whilst the wearer is outdoors, for example when playing in an amusement park or when watching sport games in the soccer stadium and baseball field. In addition, If the shade cover is soaked in water and worn, evaporation of the water results in cooling of the head and/or nape of the wearer. Furthermore, since the shade cover can be removed, it can be detached from the cup body and cleaned.

The hood structure having a hair band as the headband part and a shading cover connected together and each provided with a cold insulator for cooling the head and nape of the wearer in not blown away, even in strong winds, since it is fixable to a head firmly by wearing the hair band over hat. By cooling the back of the head and the neck, sunstroke can be prevented easily.

What is claimed is:

1. A cap comprising;

a cloth cap body;

a sunshade cover removably and rotatably connected to the cap body by means for connecting, characterized in that the sunshade cover has a cooling material, and the cooling materials is a water-absorbing material as a fiber obtained by processing a polymer that contains the sodium salt of polyacrylic acid as a major component;

wherein, in the stored position, the sunshade cover provides shading to at least the top of the person's head and in the extended position, the sunshade cover provides shading to at least the back of the person's head;

the connecting means having a projection received in a recess, arrangement of the projection in the recess allowing for rotation of the sunshade cover between the extended position and the stored position; and a fixing means for detachably fixing the sunshade cover in either the extended position or the stored position.

2. A cap according to claim 1, wherein the projection is detachably received in the recess.

3. A cap according to claim 1, wherein the projection is located on the body and the recess in located on the sunshade cover.

4. A cap comprising:

a cloth cap body:

a sunshade cover removably and rotatably connected to the cap body by means for connecting, characterized in that the sunshade cover has a cooling material, and the cooling materials is a water-absorbing material as a fiber obtained by processing a polymer that contains the sodium salt of polyacrylic acid as a major component;

wherein, in the stored position, the sunshade cover provides shading to at least the top of the person's head and in the extended position, the sunshade cover provides shading to at least the back of the person's head;

the connecting means having a projection received in a recess, arrangement of the projection in the recess allowing for rotation of the sunshade cover between the extended position and the stored position; and a fixing means for detachably fixing the sunshade cover in either the extended position or the stored position, the fixing means further including a portion of double sided adhesive, a portion of looped fastener or any other suitable means for fixing the sunshade cover to the body.

5. A cap according to claim 1, wherein the fixing means is located on either side of the cap such that in either the extended or the stored position the sunshade cover may be held in the stored position by either side of the cap.

6. A cap according to claim 1, wherein the cloth cap body is formed in the shape of a hat.

7. A cap according to claim 1, wherein the cloth cap body is formed in the shape of a hood.

* * * * *